US010149543B1

(12) United States Patent
Garlieb et al.

(10) Patent No.: US 10,149,543 B1
(45) Date of Patent: Dec. 11, 2018

(54) FOLDABLE EASEL WITH A LIGHTING SYSTEM

(71) Applicants: Stacie Lynne Garlieb, Phoenix, AZ (US); Mark Alan Garlieb, Phoenix, AZ (US)

(72) Inventors: Stacie Lynne Garlieb, Phoenix, AZ (US); Mark Alan Garlieb, Phoenix, AZ (US)

( * ) Notice: Subject to any disclaimer, the term of this patent is extended or adjusted under 35 U.S.C. 154(b) by 0 days.

(21) Appl. No.: 16/001,626

(22) Filed: Jun. 6, 2018

(51) Int. Cl.

| | |
|---|---|
| ***A47B 23/06*** | (2006.01) |
| ***A47B 97/00*** | (2006.01) |
| ***F21V 33/00*** | (2006.01) |
| ***A47B 97/08*** | (2006.01) |
| ***F21V 21/34*** | (2006.01) |
| ***F21V 21/32*** | (2006.01) |
| ***F21V 21/108*** | (2006.01) |
| ***F21V 23/02*** | (2006.01) |

(52) U.S. Cl.
CPC ..... *A47B 97/08* (2013.01); *F21V 21/108* (2013.01); *F21V 21/32* (2013.01); *F21V 21/34* (2013.01); *F21V 23/02* (2013.01); *F21V 33/0004* (2013.01)

(58) Field of Classification Search
USPC ..... 362/127, 234
See application file for complete search history.

(56) References Cited

U.S. PATENT DOCUMENTS 3,165,025 A * 1/1965 Hart ..... G03B 27/542 352/90
4,598,995 A * 7/1986 Rogers ..... G03B 27/20 355/73
5,884,888 A * 3/1999 Grimes, III ..... A47B 23/042 248/441.1
2003/0005607 A1* 1/2003 O'Hanlon ..... A47B 97/04 40/367
2004/0114373 A1* 6/2004 Lin ..... F21S 6/003 362/352
2005/0276587 A1* 12/2005 Massarsky ..... A47B 97/04 396/1
2008/0116347 A1* 5/2008 Stengel ..... A47B 97/08 248/460
2009/0039229 A1* 2/2009 Barnes ..... A47B 97/08 248/460
2010/0320354 A1* 12/2010 Prost ..... A47B 23/041 248/448
2016/0128480 A1* 5/2016 Stevens ..... A47B 97/08 248/451

* cited by examiner

*Primary Examiner* — Tuyen K Vo

(74) *Attorney, Agent, or Firm* — RG Patent Consulting, LLC; Rachel Gilboy

(57) ABSTRACT

A foldable easel with a lighting system includes a foldable frame, a left light fixture, and a right light fixture. The foldable frame includes a rear central rail, a right front rail, a left front rail, a plate, and a cross brace assembly. Three rails are hingedly connected to each other with the plate and the cross brace assembly that is centrally positioned to the foldable frame. The plate and the cross brace assembly foldably secure the rear central rail, the left front rail, and the right front rail. The left and right light fixtures are detachably mounted to the foldable frame. The left and right light fixtures are powered through a power supply system and selectively controlled by a user to direct illumination towards a painting or portrait that is held within the foldable frame.

18 Claims, 13 Drawing Sheets

FOLDABLE EASEL WITH A LIGHTING SYSTEM

CROSS-REFERENCE TO RELATED APPLICATION

The present application is related to and claims priority from prior provisional application Ser. No. 62/163,869 filed May 19, 2015, and Ser. No. 15/159,580 filed May 19, 2016, which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of easel and more specifically relates to a pre-wired foldable easel with a lighting system that includes an on/off switch and a dimmer switch

2. Description of the Related Art

Traditionally artists' easels are just a simple stand used to hold a canvas at an elevated and angled position so that an artist can easily paint. Traditional easels do not offer a lighting mechanism for the artist to use when the painting area lacks sufficient 20 lighting. Generally, artists have to use separate lighting stands to light up the painting area or the canvas when working in low light environments. This causes the painting area to be cluttered especially when the artist is working in a studio with other artists. When the amount of clutter increases around an easel, the chances of tipping over the easel or a light stand also increases. Additionally, when the artist is working on a detailed section, the artist needs the respective area to be clearly visible. Ideally, the artist would like to focus additional lighting to the working area so that the respective area can be clearly visible. This usually requires the artist to obtain a light stand that has a focused lighting system thus allowing the artist to move the focused lighting system in areas that requires additional lighting. When moving the focused lighting system to a specific area of the 30 canvas, the process is inconvenient for the artist as they have to reach over to the light stand that are usually positioned next to or behind the artist. Additionally, this also increases the probability of knocking over the light stand or any of the artist's supplies.

It is therefore an object of the present invention to provide a foldable easel that combats the aforementioned issues by integrating a lighting system directly onto the foldable easel. As a result, the present invention eliminates clutter and gives

5 the artist the ease of moving the lighting system to any specific area of the canvas. In addition to holding a canvas for an artist to work on, the present invention also provides the displaying apparatus with gallery quality lighting for an artwork and visual designs to be showcased in homes, businesses and galleries

BRIEF SUMMARY OF THE INVENTION

In view of the foregoing disadvantages inherent in the known easel art, the present invention provides novel easel advancements. The general purpose of the present invention, which will be described subsequently in greater detail is to provide an easel with a novel lighting system.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a XXX Device, constructed and operative according to the teachings of the present invention.

The various embodiments of the present invention will hereinafter be described in conjunction with the appended drawings, wherein like designations denote like elements.

DETAILED DESCRIPTION

Figure 1:
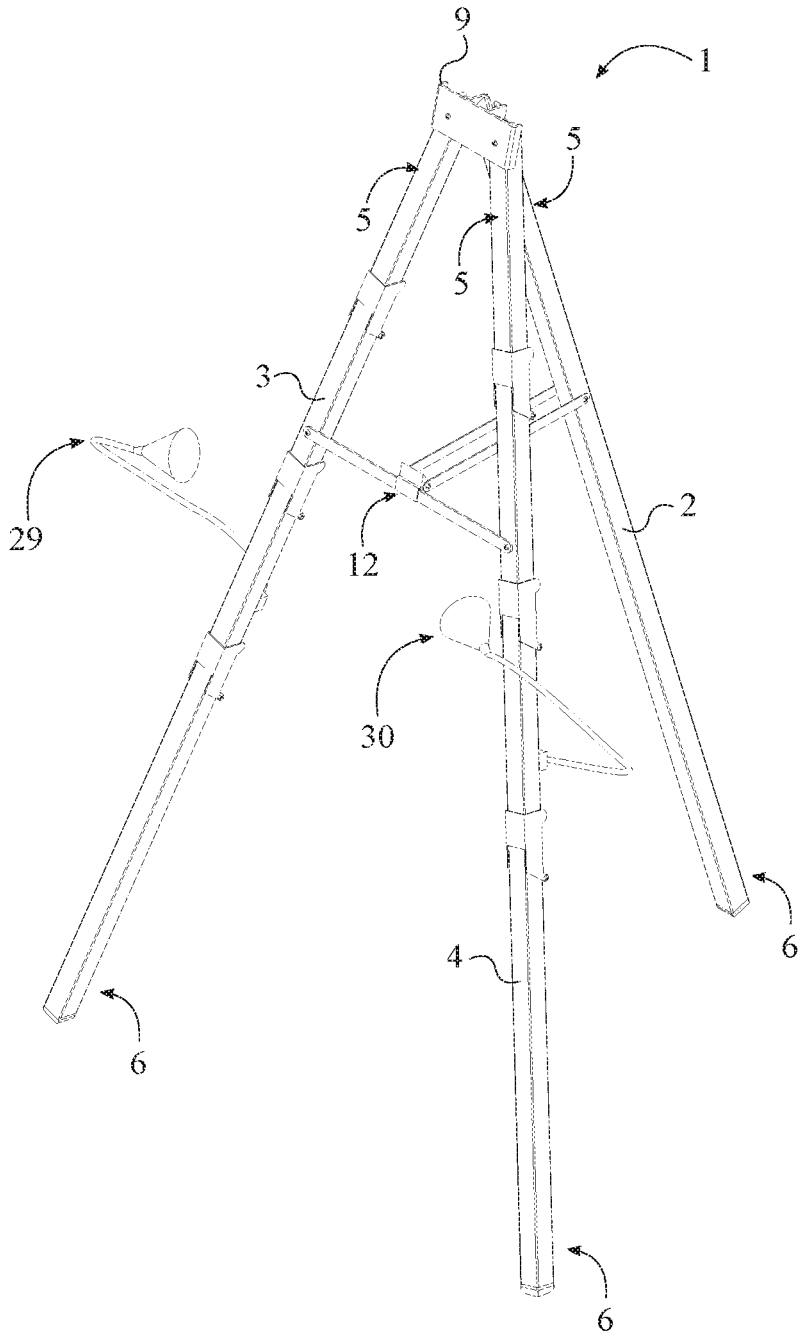
FIG. 1 is a front perspective view of the present invention.

The present invention is a foldable and portable easel with a lighting system. The present invention provides solution for limited wall space and provides multiple levels of placement for an artwork while providing essential illumination for an artwork that is placed within. As a result of the aforementioned benefits, the present invention is able to provide an improved and efficient easel compare to existing easels. The present invention comprises a foldable frame 1, a power supply system 34, a left light fixture 29, and a right light fixture 30 as shown in FIG. 1. In reference to the general configuration of the present invention, the foldable frame 1 that functions as the stand or the base of the present invention comprises a rear central rail 2, a left front rail 3, a right front rail 4, a plate 9, and a cross brace assembly 12. A proximal end 5 of the rear central rail 2, the left front rail 3, and the right front rail 4 are each hingedly connected to the plate 9 in order to form the overall shape of the foldable frame 1. The cross brace assembly 12 that stabilize foldable frame 1 is hingedly connected to the rear central rail 2, the left front rail 3, and the right front rail 4.

Additionally, the cross brace assembly 12 is positioned in between the plate 9 and a distal end 6 of the rear central rail 2, the left front rail 3, and the right front rail 4 to maintain the overall shape and structural support of the foldable frame 1. The left light fixture 29 is detachably mounted to the left front rail 3. The right light fixture 30 is detachably mounted to the right front rail 4. The left light fixture 29 and the right light fixture 30 are able to provide illumination to an artwork that is placed within the foldable frame 1 as the left light fixture 29 and the right light fixture 30 are electrically connected to the power supply system 34.

The foldable frame 1 provides the overall shape of the present invention, wherein components connections between the rear central rail 2, the left front rail 3, the right front rail 4, and the plate 9 allow the present invention to switch between an unfolded configuration and a folded configuration. More specifically, the unfolded configuration allows the user to place and support an artwork within the foldable frame 1. In particular, the distal end 6 of the rear central rail 2, the left front rail 3, and the right front rail 4 are positioned further apart from each other forming a tetrahedron pyramid shape. The folded configuration allows the user to store the present invention with minimum amount of storage space as the distal end 6 of the rear central rail 2, the left front rail 3, and the right front rail 4 are positioned adjacent to each other forming an elongated rectangular shape. Additionally, the height of the rear central rail 2, the left front rail 3, and the right front rail 4 also determine the overall height of the foldable frame 1.

Figure 2:
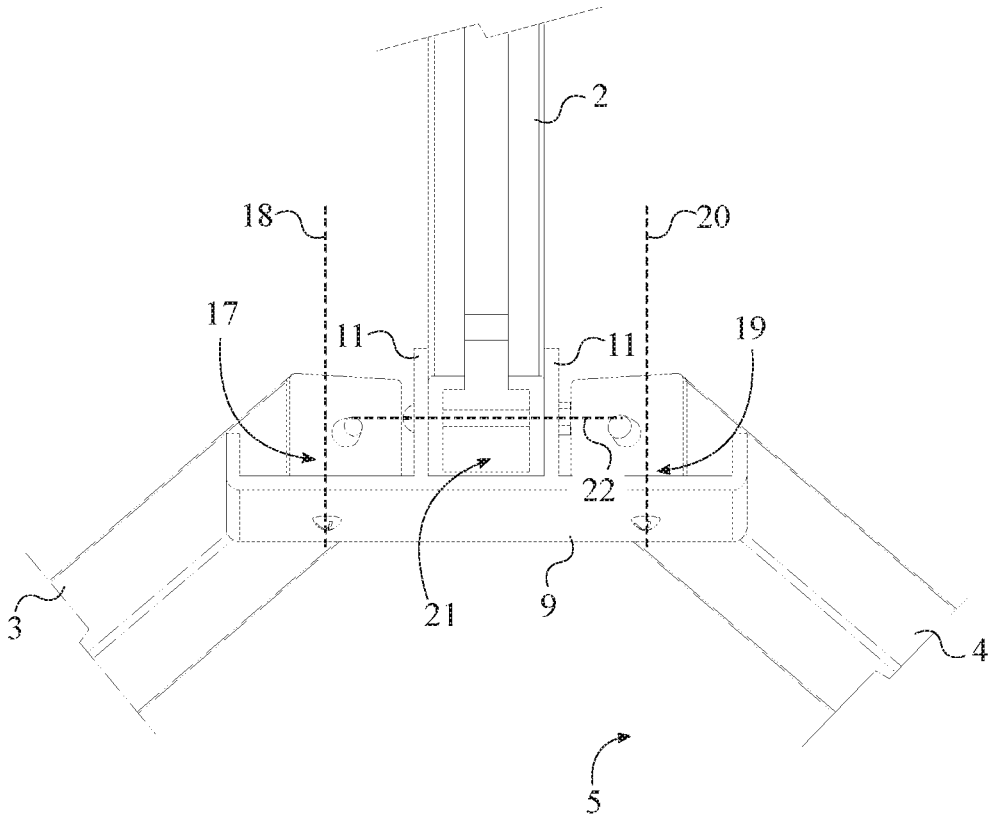
FIG. 2 is a top view of the present invention showing the first lateral joint, the second lateral joint, the rear joint, and the respective rotational axis.
Figure 4:
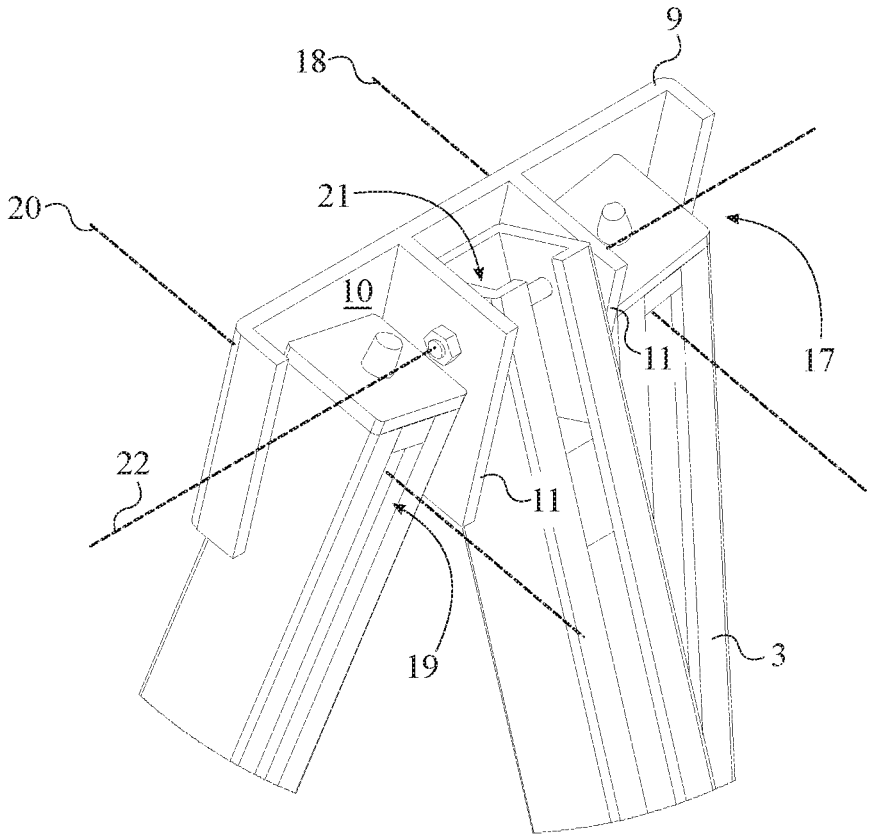
FIG. 4 is a detail view of the present invention showing the connection between the plate and the left front rail, the right front rail, and the rear central rail.
Figure 5:
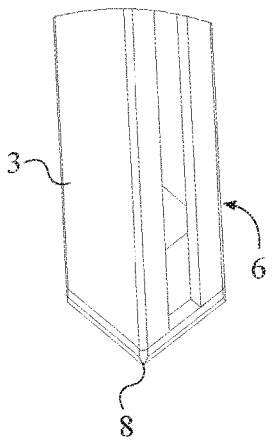
FIG. 5 is a detail view of the present invention showing the no-slip foot member within the left front rail.
Figure 6:
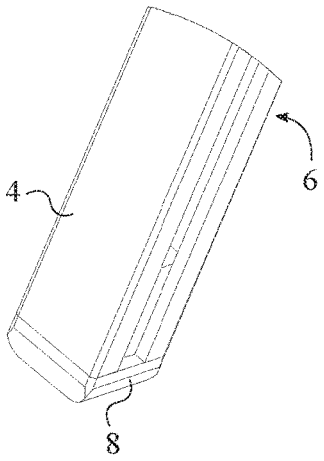
FIG. 6 is a detail view of the present invention showing the no-slip foot member within the right front rail.
Figure 7:
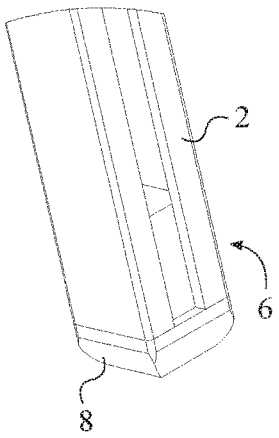
FIG. 7 is a detail view of the present invention showing the no-slip foot member within the rear central rail.

In reference to FIG. 2 and FIG. 4, the plate 9 functions as a connecting member within the present invention as the left front rail 3 and the right front rail 4 are connected to a rear surface 10 of the plate 9. More specifically, the proximal end 5 of the left front rail 3 is hingedly mounted to the rear surface 10 of the plate 9 by a left lateral joint 17. Similarly, the proximal end 5 of the right front rail 4 is hingedly mounted to the rear surface 10 of the plate 9 by a right lateral joint 19. The left lateral joint 17 and the right lateral joint 19 are oppositely positioned of each other across the plate 9 in such a way that a rotational axis 18 of the left lateral joint 17 is oriented parallel to a rotational axis 20 of the right lateral joint 19. In order to form the tetrahedron pyramid shape, the plate 9 comprises a pair of perpendicular supports 11 that are vertically positioned along the rear surface 10 of the plate 9. In reference to FIG. 2, the proximal end 5 of the rear central rail 2 is hingedly mounted to the pair of perpendicular supports 11 by a rear joint 21 that is positioned in between the left lateral joint 17 and the right lateral joint 19. However, a rotational axis 22 of the rear joint 21 is oriented perpendicular to the rotational axis 18 of the left lateral joint 17 and the rotational axis 20 of the right lateral joint 19. As a result, the left front rail 3 and the right front rail 4 are able to radially extend outward about the left lateral joint 17 and the right lateral joint 19 respectively. The rear central rail 2 can radially extend backward about the rear joint 21, resulting the tetrahedron pyramid shape. In reference to FIG. 5-7, the foldable frame 1 further comprises a plurality of no-slip foot members 8 to improve the traction between the foldable frame 1 and the resting surface that the present invention is placed upon. More specifically, each no-slip foot member 8 is adjacently connected to the distal end 6 of the rear central rail 2, the left front rail 3, and the right front rail 4. The plurality of no-slip foot members 8 ensures that the foldable frame 1 does not slip or move laterally on the resting surface. The cross brace assembly 12 limits how far the rear central rail 2, the left front rail 3, and the right front rail 4 can extend about the respective rotational axis without compromising the structural integrity of the present invention.

Figure 3:
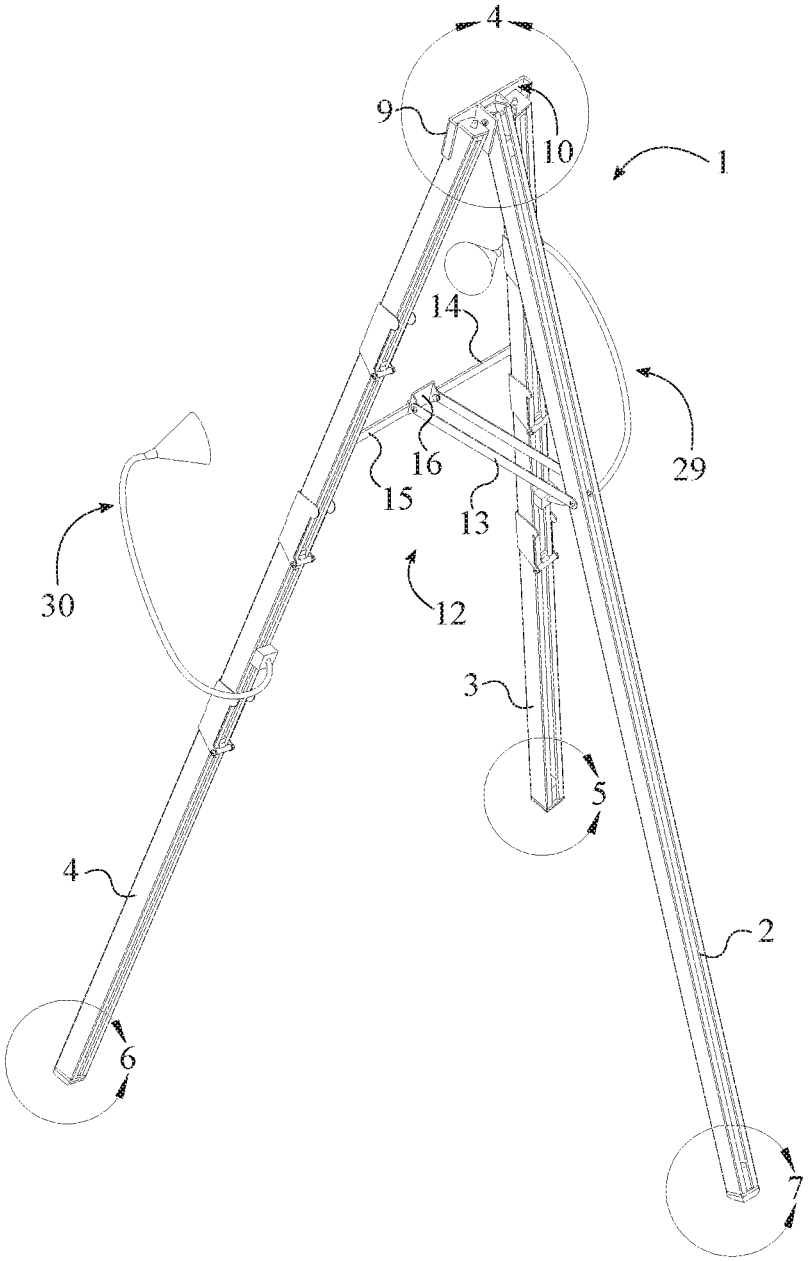
FIG. 3 is a rear perspective view of the present invention.

In reference to FIG. 3, the cross brace assembly 12 comprises a rear brace 13, a left front brace 14, a right front brace 15, and a mounting hub 16. The rear brace 13, the left front brace 14, and the right front brace 15 are interconnected to each other by the mounting hub 16 so that the foldable frame 1 can switch between the folded configuration and the unfolded configuration, without putting excessive pressure on the left lateral joint 17, the right lateral joint 19, and the rear joint 21. More specifically, the mounting hub 16 and the left front rail 3 are hingedly mounted to each other by the left front brace 14. The mounting hub 16 and the right front rail 4 are hingedly mounted to each other by the right front brace 15. In order to aligned with the left front rail 3 and the right front rail 4, the left front brace 14 and the right front brace 15 are oppositely positioned of each other about the mounting hub 16. The mounting hub 16 and the rear central rail 2 are hingedly mounted to each other by the rear brace 13 as the rear brace 13 is perpendicularly positioned of the left front brace 14 and the right front brace 15 when the present invention is at the unfolded configuration. Since the rear brace 13, the left front brace 14, the right front brace 15, and the mounting hub 16 are made of rigid structural material, the cross brace assembly 12 is able to regulate the distance traveled by the rear central rail 2, the left front rail 3, and the right front rail 4 from the folded configuration to the unfolded configuration and vice versa.

The present invention further comprises at least one pair of platforms so that an artwork can be placed upon the pair of platforms and rested against the left front rail 3 and the right front rail 4. In other words, the pair of platforms provide a surface on which an artwork may rest upon. However, the present invention is not limited to only one pair of platforms and the number of platform pairs can differ upon different embodiments and user requirements.

In reference to a preferred embodiment of the foldable frame 1, the present invention further comprises a left upper platform 23, a right upper platform 24, a left lower platform 25, a right lower platform 26, a left intermediary platform 27, and a right intermediary platform 28. In reference to FIG. 8, the left upper platform 23, the left lower platform 25, and the left intermediary platform 27 are hingedly connected to the left front rail 3. Similarly, the right upper platform 24, the right lower platform 26, and the right intermediary platform 28 are hingedly connected to the right front rail 4. In reference to FIG. 8, the left upper platform 23, the left lower platform 25, and the left intermediary platform 27 are positioned adjacent to a front surface 7 of the left front rail 3. More specifically, the left upper platform 23 is positioned in between the plate 9 and the cross brace assembly 12. The left lower platform 25 is positioned in between the cross brace assembly 12 and the distal end 6 of the left front rail 3. The left intermediary platform 27 is positioned in between the left upper platform 23 and the left lower platform 25.

Figure 8:
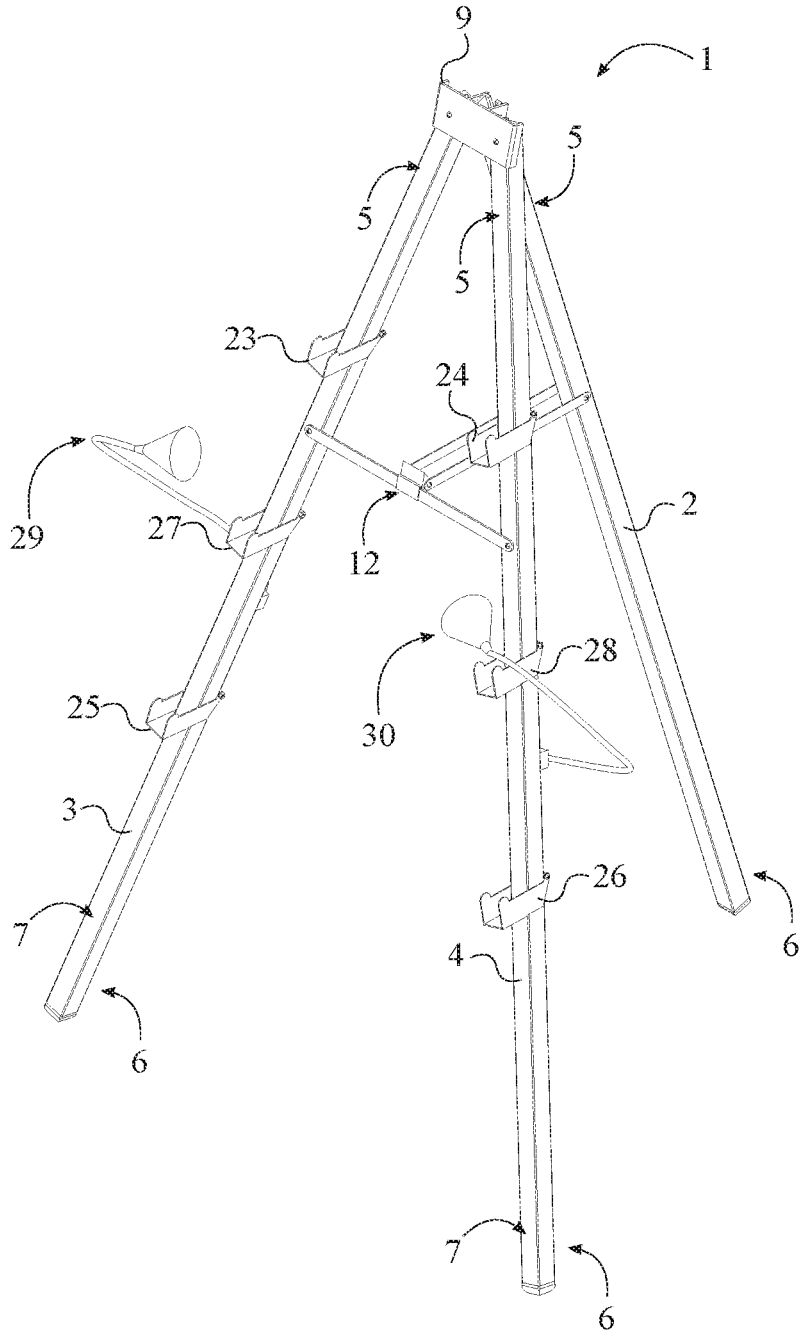
FIG. 8 is a front perspective view of the preferred embodiment of the foldable frame showing the plurality of platforms.

In reference to FIG. 8, the right upper platform 24, the right lower platform 26, and the right intermediary platform 28 are positioned adjacent to a front surface 7 of the right front rail 4. More specifically, the right upper platform 24 is positioned in between the plate 9 and the cross brace assembly 12. The right lower platform 26 is positioned in between the cross brace assembly 12 and the distal end 6 of the right front rail 4. The right intermediary platform 28 is positioned in between the right upper platform 24 and the right lower platform 26. As a result, the user is able to selectively positioned an artwork within the preferred embodiment of the foldable frame 1 utilizing three different height levels. For example, the user can utilize the left upper platform 23 and the right upper platform 24 to attain the highest elevation for an artwork as left upper platform 23 and the right upper platform 24 become the pair of platforms. Similarly, the user can utilize the left lower platform 25 and the right lower platform 26 to attain the lowest elevation for an artwork as left lower platform 25 and the right lower platform 26 become the pair of platforms. Likewise, the user can utilize the left intermediary platform 27 and the right intermediary platform 28 to attain the intermediate elevation for an artwork as left intermediary platform 27 and the right intermediary platform 28 become the pair of platforms.

Figure 9:
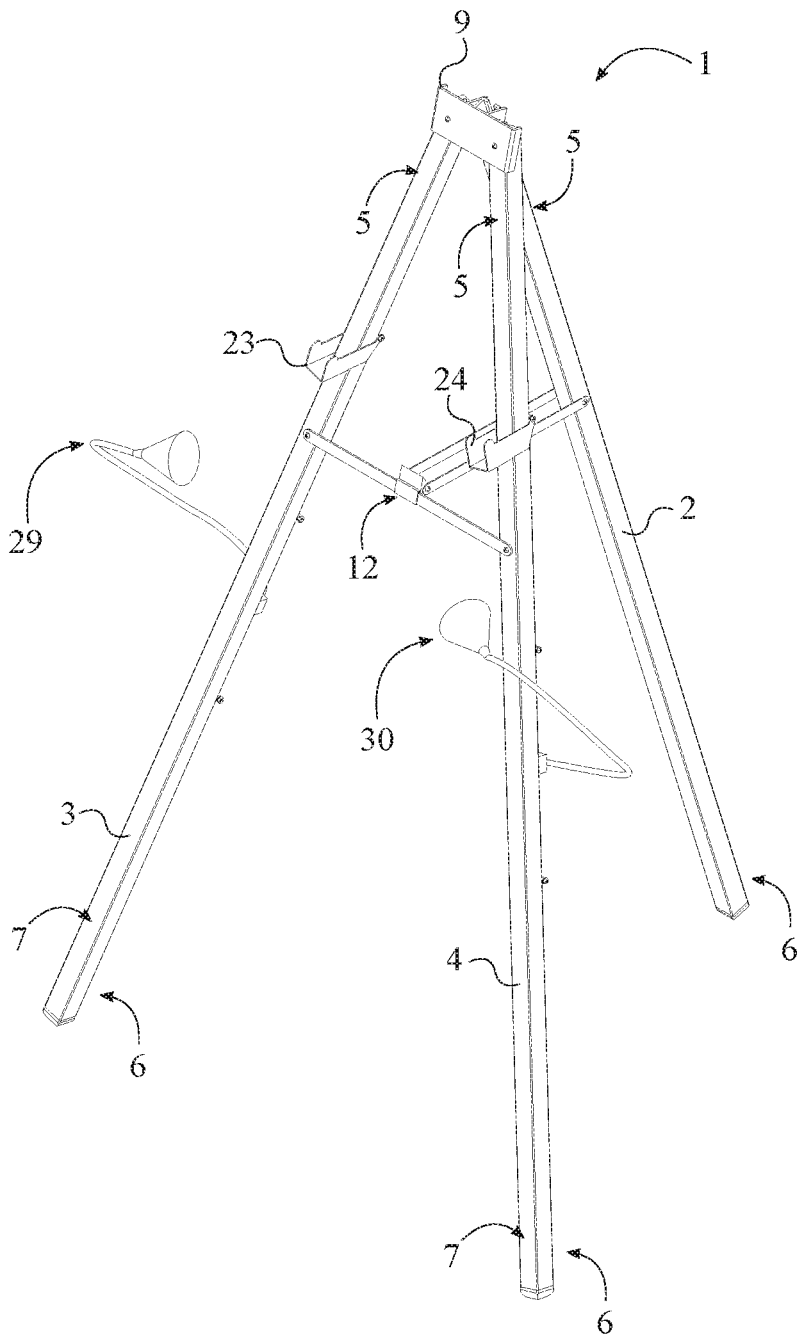
FIG. 9 is a front perspective view of the first alternative embodiment of the foldable frame showing the plurality of upper platforms.

In reference to a first alternative embodiment of the foldable frame 1, the present invention can comprise only the left upper platform 23 and the right upper platform 24. In reference to FIG. 9, the left upper platform 23 is hingedly connected to the left front rail 3. The right upper platform 24 is hingedly connected to the right front rail 4. More specifically, the left upper platform 23 is positioned adjacent to the front surface 7 of the left front rail 3, wherein the left upper platform 23 is positioned in between the plate 9 and the cross brace assembly 12. The right upper platform 24 is positioned adjacent to the front surface 7 of the right front rail 4, wherein the right upper platform 24 is positioned in between the plate 9 and the cross brace assembly 12. Since the left upper platform 23 and the right upper platform 24 are the only pair of platforms within the first alternative embodiment of the foldable frame 1, the user can only utilize the left upper platform 23 and the right upper platform 24 to place an artwork. For example, the first alternative embodiment of the foldable frame 1 is ideal for small sized artworks.

Figure 10:
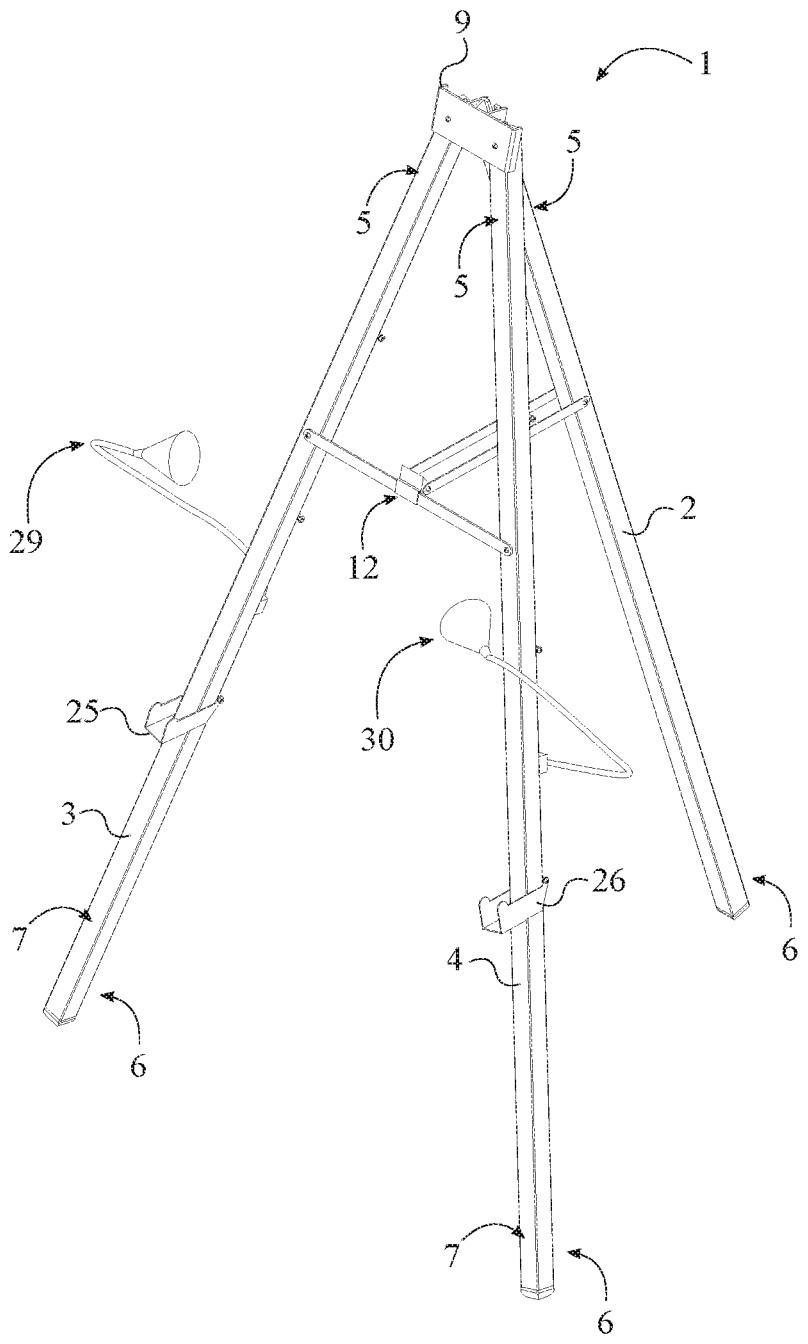
FIG. 10 is a front perspective view of the second alternative embodiment of the foldable frame showing the plurality of lower platforms.

In reference to a second alternative embodiment of the foldable frame 1, the present invention can comprise only the left lower platform 25 and the right lower platform 26. In reference to FIG. 10, the left lower platform 25 is hingedly connected to the left front rail 3. The right lower platform 26 is hingedly connected to the right front rail 4. More specifically, the left lower platform 25 is positioned adjacent to the front surface 7 of the left front rail 3, wherein the left lower platform 25 is positioned in between the cross brace assembly 12 and the distal end 6 of the left front rail 3. The right lower platform 26 is positioned adjacent to the front surface 7 of the right front rail 4, wherein the right lower platform 26 is positioned in between the cross brace assembly 12 and the distal end 6 of the right front rail 4. Since the left lower platform 25 and the right lower platform 26 are the only pair of platforms within the second alternative embodiment of the foldable frame 1, the user can only utilize the left lower platform 25 and the right lower platform 26 to place an artwork. For example, the second alternative embodiment of the foldable frame 1 is ideal for large sized artworks.

Figure 11:
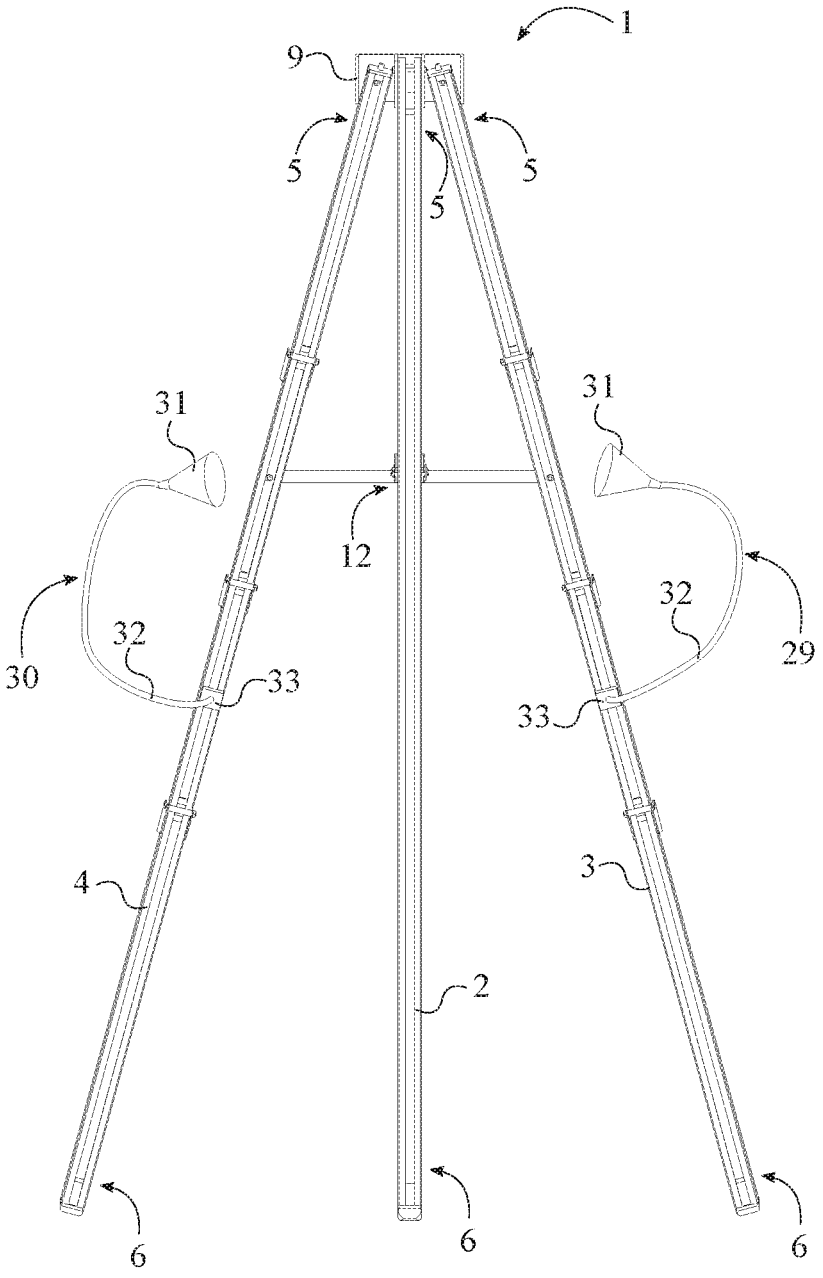
FIG. 11 is a rear view of the present invention showing the connection of the left light fixture and the right light fixture.

The left light fixture 29 provides illumination to an artwork that is placed within the foldable frame 1 from the left side while the right light fixture 30 provides illumination from the right side. In reference to FIG. 1 and FIG. 11, the left light fixture 29 and the right light fixture 30 each comprise an illuminating device 31, a malleable arm 32, and a track fixture 33. The illuminating device 31, preferably a 5 plurality of light-emitting diodes, is mounted to the track fixture 33 by the malleable arm 32 so that the user is able to redirect the illuminating device 31 as needed. Since the malleable arm 32 maintains the user defined angles and shapes, the left light fixture 29 and the right light fixture 30 can provide a direct lighting beam towards an artwork. The track fixture 33 of the left light fixture 29 is detachably engaged with the left front rail 3. The track fixture 33 of the right light fixture 30 is detachably engaged with the right front rail 4. As a result, the left light fixture 29 is detachably positioned in between the proximal end 5 and the distal end 6 of the left front rail 3. Likewise, the right light fixture 30 is detachably positioned in between the proximal end 5 and the distal end 6 of the right front rail 4.

Figure 12:
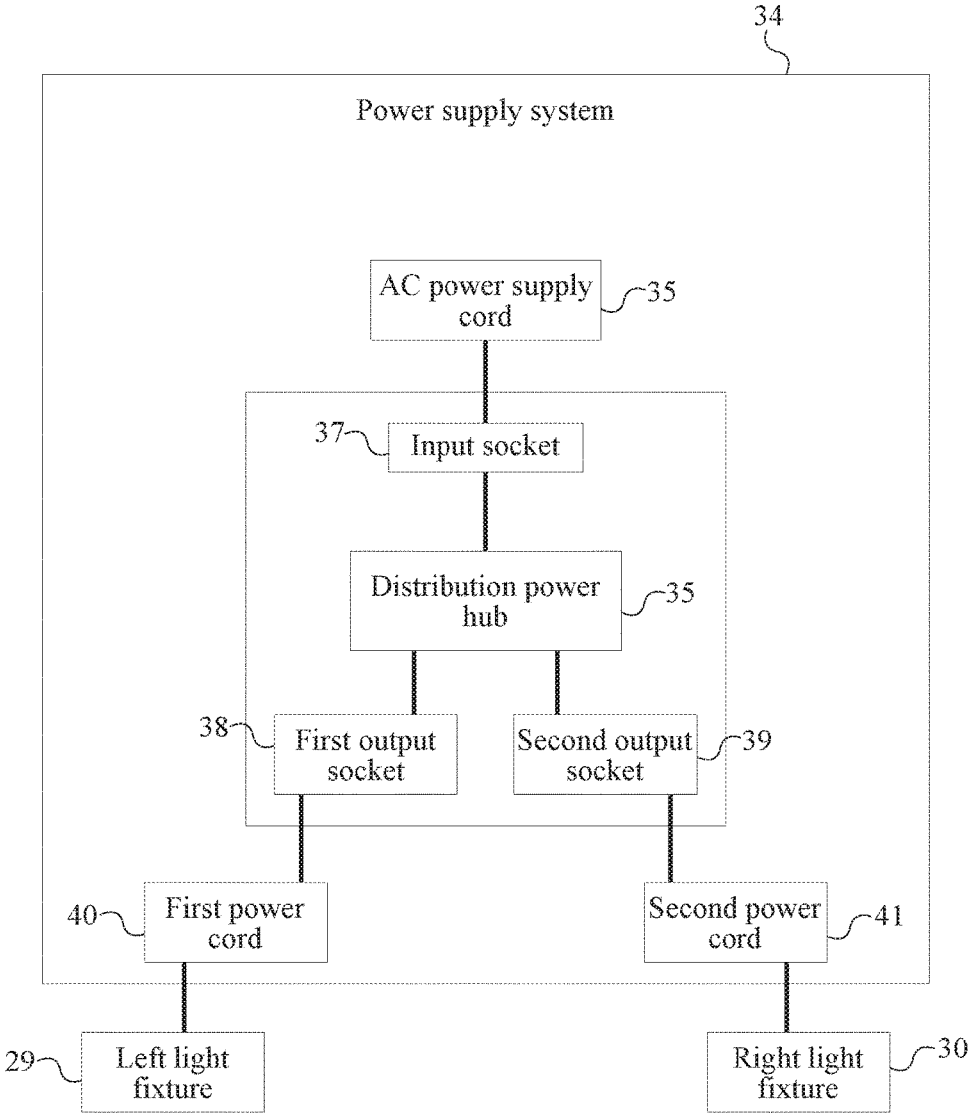
FIG. 12 is a basic schematic diagram showing the AC electrical system within the present invention.

Additionally, the left light fixture 29 and the right light fixture 30 can also function as a slidable lighting system within the present invention when required by the user. The power supply system 34 powers the left light fixture 29 and the right light fixture 30 within the present invention. Depending upon user preference, the power supply system 34 can be an alternative current (AC) system or a direct current (DC) system. In reference to the AC system that is shown in FIG. 12, the power supply system 34 comprises an AC power supply cord 35, a distribution power hub 36, a first power cable 40, and a second power cable 41. The AC power supply cord 35, the distribution power hub 36, the first power cable 40, the second power cable 41 function as a single electrical apparatus and preferably positioned within rear central rail 2 so that electricity can be supplied to the left light fixture 29 and the right light fixture 30. More specifically, the AC power supply cord 35 is electrically connected to an input socket 37 of the distribution power hub 36 so that the distribution power hub 36 is able receive electricity from an external power source. Additionally, the left light fixture 29 is electrically connected with a first output socket 38 of the distribution power hub 36 by the first power cable 40. Similarly, the right light fixture 30 is electrically connected with a second output socket 39 of the distribution power hub 36 by the second power cable 41.

Optionally, the left front rail 3 and the right front rail 4 may each further comprises a pair of integrated electrical tracks that the first power cable 40 and the second power cable 41 electrically connect with. The pair of integrated electrical tracks is internally positioned and extended along left front rail 3 and the right front rail 4. More specifically, the pair of integrated electrical tracks of the left front rail 3 electrically connects with 5 the first power cable 40 about the proximal end 5 of the left front rail 3 so that the left light fixture 29 can be powered through the pair of integrated electrical tracks of the left front rail 3. Similarly, the pair of integrated electrical tracks of the right front rail 4 electrically connects with the second power cable 41 about the proximal end 5 of the right front rail 4 so that the right light fixture 30 can be powered through the pair of integrated electrical tracks of the left front rail 4.

Figure 13:
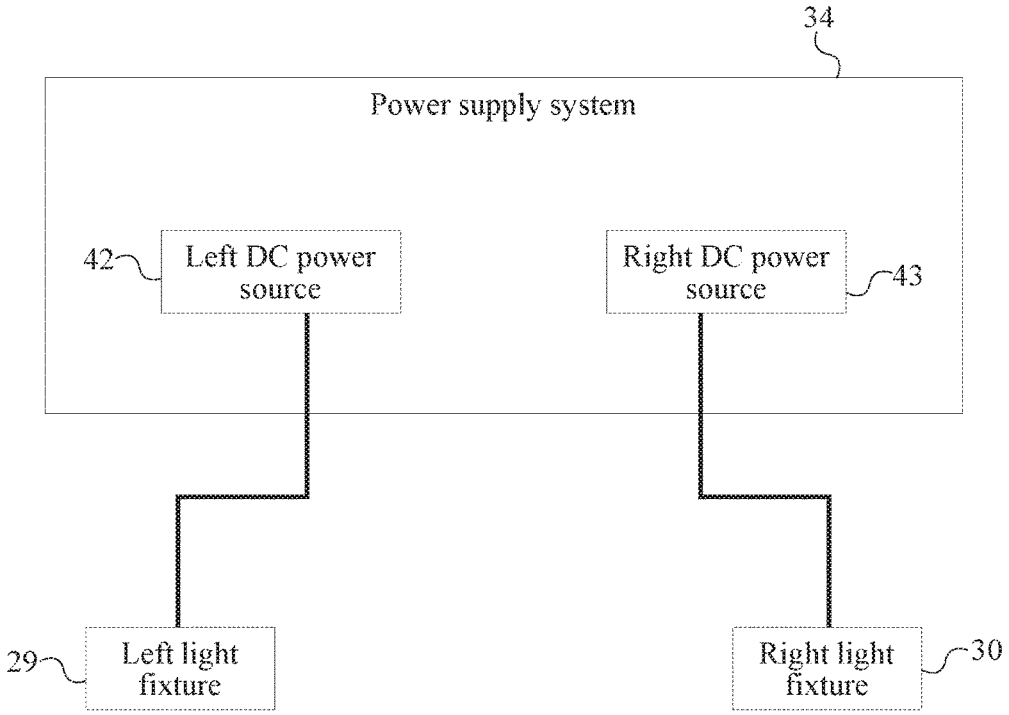
FIG. 13 is a basic schematic diagram showing the DC electrical system within the present invention.

In reference to the DC system that is shown in FIG. 13, the power supply system 34 comprises a left DC power source 42 and a right DC power source 43. More specifically, the left DC power source 42 is internally positioned with the left front rail 3 and electrically connected to the left light fixture 29. Similarly, the right DC power source 43 is internally positioned with the right front rail 4 and electrically connected to the right light fixture 30.

The power supply system 34 can further comprise an on/off switch and a dimmer switch. The on/off switch providing selective control over the left light fixture 29 and/or the right light fixture 30. For example, if the user desires only the left light fixture 29 is required for a specific artwork, the user can activate only the left light fixture 29 through the on/off switch. The dimmer switch allows the user control the brightness of the illuminating device 31 to create the precise lighting effects from the left light fixture 29 and/or the right light fixture 30.

Figure 15:
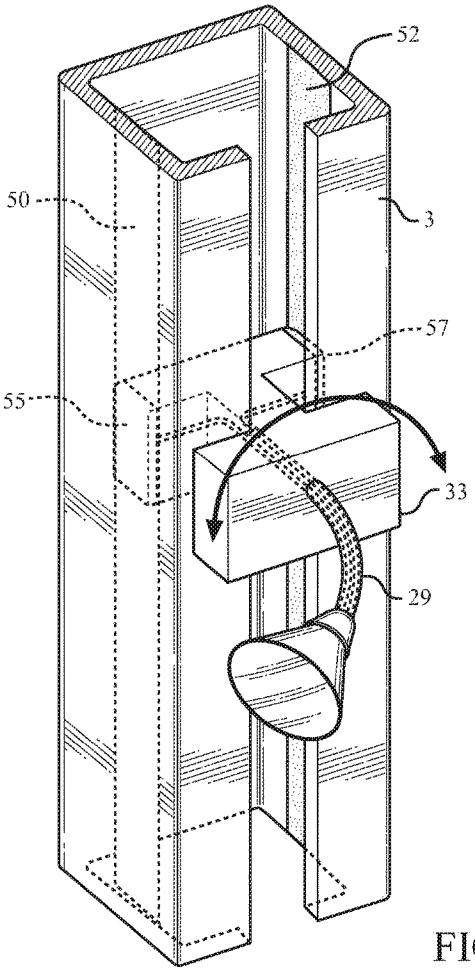
FIG. 15 is a perspective view illustrating a light fixture inserted into a front rail via its track fixture.
Figure 14:
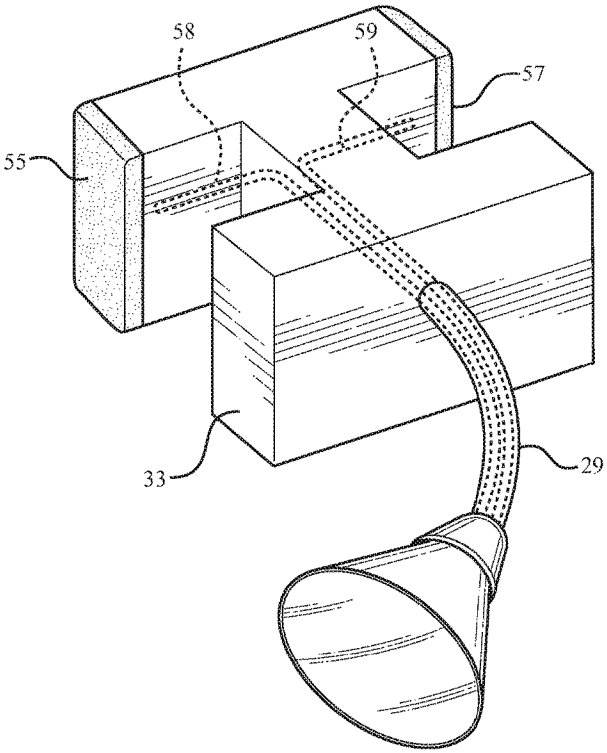
FIG. 14 is a perspective view illustrating a light fixture including a track fixture.
Figure 16:
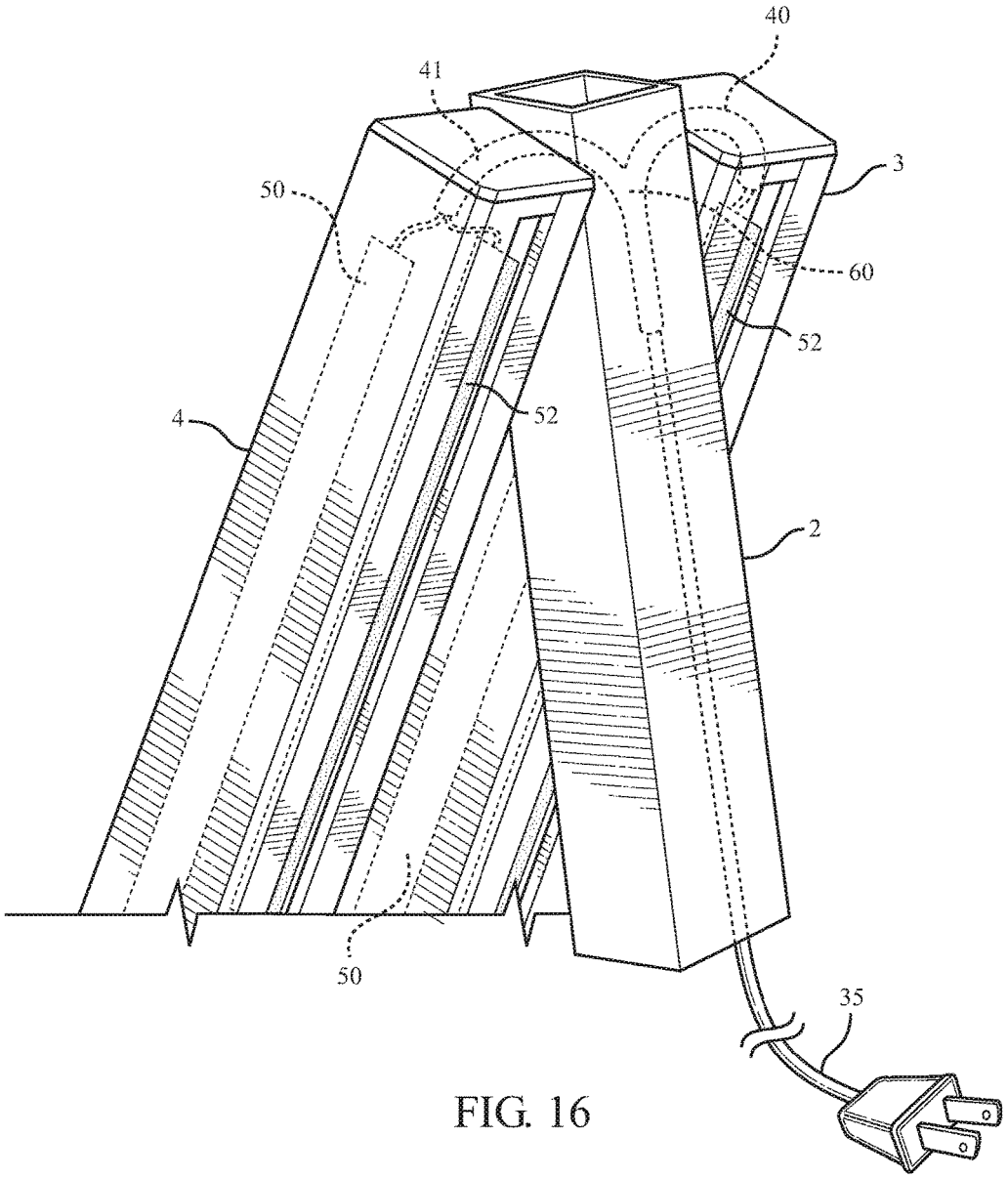
FIG. 16 is a perspective view illustrating a Y-shaped connector connected between and extending into ends of the rear central rail, the left front rail, and the right front rail of the foldable frame and adapted to insulate and protect power cords passing therethrough.

In reference to a preferred embodiment of the foldable frame 1, and shown in FIGS. 14-16, the left front rail 3 includes an elongated channel extending along the length thereof and includes two parallel and spaced elongated electrical power strips (50 and 52) attached therein and extending along a substantial portion of its length and are respectively connected to the power supply system 34 and are adapted such that when the left light fixture is connected to the left front rail via the elongated channel it contacts the two parallel and spaced elongated electrical power strips to complete an electrical circuit via electric wires 58 and 59 to thereby provide power to the left light fixture; and wherein the right front rail 4 includes an elongated channel extending along the length thereof and includes two parallel and spaced elongated electrical power strips (50 and 52) and extending along a substantial portion of its length and are respectively connected to the power supply system 34 and are adapted such that when the right light fixture is connected to the right front rail via the elongated channel it contacts the two parallel and spaced elongated electrical power strips to complete an electrical circuit via electric wires 58 and 59 to thereby provide power to the right light fixture.

Within the aforementioned preferred embodiment, the elongated channel of the left front rail 3 is formed having a C-shape and adapted such that the left light fixture 29 can be slidably moved along the length thereof and releasably held at selected locations therein; and wherein said elongated channel of the right front rail 4 is C-shaped and adapted such that the right light fixture 30 can be slidably moved along the length thereof and releasably held at selected locations therein. Further, the track fixture 33 of the left light fixture 29 has an H-shaped cross-section and is adapted to slidably and frictionally engage within the C-shaped channel of the left front rail, and the track fixture 33 of said right light fixture 30 has an H-shaped cross-section and is adapted to slidably and frictionally engage within the C-shaped channel of the right front rail. Furthermore, the track fixture of the left light fixture includes spaced electrical power strip connector members 55 and 57 adapted to make contact with respective the electrical power strips 50 and 52 of the left front rail, to thereby complete the electrical circuit and thereby provide power to the left light fixture; and wherein the track fixture of the right light fixture includes spaced electrical power strip connector members 55 and 57 adapted to make contact with respective electrical power strips 50 and 52 of the right front rail, to thereby complete the electrical circuit and thereby provide power to the right light fixture.

Further within the aforementioned preferred embodiment, and as shown in FIG. 16, the foldable easel with a lighting system further includes a Y-shaped tubular connector member 60 connected between and extending into respective proximal ends of the rear central rail, the left front rail, and the right front rail. Further, the elongated electrical power strips of the left front rail and the right front rail are respectively connected to the power supply system via power cords 40 and 41, and wherein these power cords respectively pass through the Y-shaped tubular connector member and extend and connect with a power supply of the power supply system, such that the power cords are protected when the rear central rail, the left front rail, and the right front rails are pivoted. Furthermore, the power cords of the left front rail and the right front rail can extend along the rear central rail after passing through the Y-shaped tubular connector member and then connect with the power supply of the power supply system. Furthermore, the Y-shaped tubular connector member can be formed from a plastic material so as to insulate and protect the electrical wires passing therethrough.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A foldable easel with a lighting system comprises:

a foldable frame;

a power supply system;

a left light fixture;

a right light fixture;

the foldable frame comprises a rear central rail, a left front rail, a right front rail, a plate, and a cross brace assembly;

wherein said left front rail includes an elongated channel extending a substantial length thereof; wherein said elongated channel includes two parallel and spaced elongated electrical power strips attached therein, wherein both of said elongated electrical power strips are respectively connected to said power supply system and adapted such that when said left light fixture is connected to said left front rail via said elongated channel it contacts said two parallel and spaced elongated electrical power strips to complete an electrical circuit and thereby provide power to said left light fixture;

wherein said right front rail includes an elongated channel extending a substantial length thereof; wherein said elongated channel includes two parallel and spaced elongated electrical power strips attached therein, wherein both of said elongated electrical power strips are respectively connected to said power supply system and adapted such that when said right light fixture is connected to said left front rail via said elongated channel it contacts said two parallel and spaced elongated electrical power strips to complete an electrical circuit and thereby provide power to said left light fixture;

a proximal end of the rear central rail, the left front rail, and the right front rail each being hingedly connected to the plate;

the cross brace assembly being hingedly connected to the rear central rail, the left front rail, and the right front rail;

the cross brace assembly being positioned in between the plate and a distal end of the rear central rail, the left front rail, and the right front rail;

the left light fixture being detachably mounted to the left front rail;

the right light fixture being detachably mounted to the right front rail; and the left light fixture and the right light fixture being electrically connected to the power supply system;

wherein said left light fixture and said right light fixture each comprise an illuminating device, a malleable arm, and a track fixture;

wherein each said illuminating device is adapted to be mounted to a respective said track fixture via its respective said malleable arm;

wherein said track fixture of said left light fixture is adapted to slide within and removably connect with said left front rail via said elongated channel; and wherein said track fixture of said right light fixture is adapted to slide within and removably connect with said right front rail via said elongated channel.

2. The foldable easel with a lighting system as claimed in claim 1 wherein;

the proximal end of the left front rail being hingedly mounted to a rear surface of the plate by a left lateral joint;

the proximal end of the right front rail being hingedly mounted to the rear surface of the plate by a right lateral joint;

the proximal end of the rear central rail being hingedly mounted to a pair of perpendicular supports of the plate by a rear joint;

the rear joint being positioned in between the left lateral joint and the right lateral joint;

a rotational axis of the left lateral joint being oriented parallel to a rotational axis of the right lateral joint; and a rotational axis of the rear joint being oriented perpendicular to the rotational axis of the right lateral joint and the rotational axis of the left lateral joint.

3. The foldable easel with a lighting system as claimed in claim 1 wherein said foldable frame includes a plurality of no-slip foot members; and each no-slip foot member being adjacently connected to the distal end of the rear central rail, the left front rail, and the right front rail.

4. The foldable easel with a lighting system as claimed in claim 1 wherein;

the cross brace assembly comprises a rear brace, a left front brace, a right front brace, and a mounting hub;

the mounting hub and the left front rail being hingedly mounted to each other by the left front brace;

the mounting hub and the right front rail being hingedly mounted to each other by the right front brace;

the left front brace and the right front brace being oppositely positioned of each other about the mounting hub;

the mounting hub and the rear central rail being hingedly mounted to each other by the rear brace; and the rear brace being perpendicularly positioned of the left front brace and the right front brace.

5. The foldable easel with a lighting system as claimed in claim 1 further comprising:

a left upper platform;

a right upper platform;

the left upper platform being hingedly connected to the left front rail;

the left upper platform being positioned adjacent to a front surface of the left front rail;

the left upper platform being positioned in between the plate and the cross brace assembly;

the right upper platform being hingedly connected to the right front rail;

the right upper platform being positioned adjacent to a front surface of the right front rail; and the right upper platform being positioned in between the plate and the cross brace assembly.

6. The foldable easel with a lighting system as claimed in claim 1 further comprising;

a left lower platform;

a right lower platform;

the left lower platform being hingedly connected to the left front rail;

the left lower platform being positioned adjacent to a front surface of the left front rail;

the left lower platform being positioned in between the cross brace assembly and the distal end of the left front rail;

the right lower platform being hingedly connected to the right front rail;

the right lower platform being positioned adjacent to a front surface of the right front rail; and the right lower platform being positioned in between the cross brace assembly and the distal end of the right front rail.

7. The foldable easel with a lighting system as claimed in claim 1 further comprising;

a left upper platform;

a right upper platform;

a left lower platform;

a right lower platform;

a left intermediary platform;

a right intermediary platform;

the left upper platform, the left lower platform, and the left intermediary platform being hingedly connected to the left front rail;

the left upper platform, the left lower platform, and the left intermediary platform being positioned adjacent to a front surface of the left front rail;

the left upper platform being positioned in between the plate and the cross brace assembly;

the left lower platform being positioned in between the cross brace assembly and the distal end of the left front rail;

the left intermediary platform being positioned in between the left upper platform and the left lower platform;

the right upper platform, the right lower platform, and the right intermediary platform being hingedly connected to the right front rail;

the right upper platform, the right lower platform, and the right intermediary platform being positioned adjacent to a front surface of the right front rail;

the right upper platform being positioned in between the plate and the cross brace assembly;

the right lower platform being positioned in between the cross brace assembly and the distal end of the right front rail; and the right intermediary platform being positioned in between the right upper platform and the right lower platform.

8. The foldable easel with a lighting system as claimed in claim 1 wherein;

the left light fixture being detachably positioned in between the proximal end and the distal end of the left front rail; and the right light fixture being detachably positioned in between the proximal end and the distal end of the right front rail.

9. The foldable easel with a lighting system as claimed in claim 1 wherein;

the power supply system comprises an alternating current (AC) power supply cord, a distribution power hub, a first power cable, and a second power cable;

the distribution power hub comprises an input socket, a first output socket, and a second output socket;

the AC power supply cord being electrically connected to the input socket;

the left light fixture being electrically connected with the first output socket by the first power cable; and the right light fixture being electrically connected with the second output socket by the second power cable.

10. The foldable easel with a lighting system as claimed in claim 1 wherein;

the power supply system comprises a left direct current (DC) power source and a right DC power source;

the left DC power source being internally positioned with the left front rail;

the left DC power source being electrically connected to the left light fixture;

the right DC power source being internally positioned with the right front rail; and the right DC power source being electrically connected to the right light fixture.

11. The foldable easel with a lighting system as claimed in claim 1 wherein;

the proximal end of the left front rail being hingedly mounted to a rear surface of the plate by a left lateral joint;

the proximal end of the right front rail being hingedly mounted to the rear surface of the plate by a right lateral joint;

the proximal end of the rear central rail being hingedly mounted to a pair of perpendicular supports of the plate by a rear joint;

each no-slip foot member being adjacently connected to the distal end of the rear central rail, the left front rail, and the right front rail;

the rear joint being positioned in between the left lateral joint and the right lateral joint;

a rotational axis of the left lateral joint being oriented parallel to a rotational axis of the right lateral joint; and a rotational axis of the rear joint being oriented perpendicular to the rotational axis of the right lateral joint and the rotational axis of the left lateral joint.

12. The foldable easel with a lighting system as claimed in claim 1, wherein said elongated channel of said left front rail is C-shaped and adapted such that said left light fixture can be slidably moved along said length thereof and releasably held at selected locations therein; and wherein said elongated channel of said right front rail is C-shaped and adapted such that said right light fixture can be slidably moved along said length thereof and releasably held at selected locations therein.

13. The foldable easel with a lighting system as claimed in claim 12, wherein said track fixture of said left light fixture has an H-shaped cross-section and is adapted to slidably and frictionally engage within said C-shaped channel of said left front rail; and wherein said track fixture of said right light fixture is has an H-shaped cross-section and is adapted to slidably and frictionally engage within said C-shaped channel of said right front rail.

14. The foldable easel with a lighting system as claimed in claim 1, further comprising:

a Y-shaped tubular connector member;

wherein said Y-shaped tubular connector member is connected between and extends into said respective proximal ends of said rear central rail, said left front rail, and said right front rail, and adapted to insulate and protect power cords passing therethrough.

15. The foldable easel with a lighting system as claimed in claim 14, wherein said elongated electrical power strips are respectively connected to said power supply system via power cords; and wherein said power cords of said left front rail and said right front rail respectively pass through said Y-shaped tubular connector member and extend and connect with said power supply system, such that said power cords are protected when said rear central rail, said left front rail, and said right front rails are pivoted.

16. The foldable easel with a lighting system as claimed in claim 15, wherein said power cords of said left front rail and said right front rail respectively pass through said Y-shaped tubular connector member and extend along said rear central rail and connect with a power supply of said power supply system.

17. The foldable easel with a lighting system as claimed in claim 14, wherein said Y-shaped tubular connector member is formed from a plastic material.

18. The foldable easel with a lighting system as claimed in claim 1, wherein said track fixture of said left light fixture includes spaced electrical power strip connector members adapted to make contact with respective said electrical power strips of said left front rail, to thereby complete said electrical circuit and thereby provide power to said left light fixture; and wherein said track fixture of said right light fixture includes spaced electrical power strip connector members adapted to make contact with respective said electrical power strips of said right front rail, to thereby complete said electrical circuit and thereby provide power to said right light fixture.

* * * * *